US012310467B2

(12) United States Patent
Zhang

(10) Patent No.: US 12,310,467 B2
(45) Date of Patent: May 27, 2025

(54) CONNECTOR APPLIED TO WATCHBAND, WATCHBAND AND WATCH

(71) Applicant: Shenzhen Honghuanglan Technology Co., Ltd., Shenzhen (CN)

(72) Inventor: Chaoying Zhang, Shenzhen (CN)

(73) Assignee: Shenzhen Honghuanglan Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/313,331

(22) Filed: May 6, 2023

(65) Prior Publication Data

US 2024/0324737 A1 Oct. 3, 2024

(51) Int. Cl.
*A44C 5/14* (2006.01)

(52) U.S. Cl.
CPC ..... *A44C 5/14* (2013.01); *A44D 2203/00* (2013.01)

(58) Field of Classification Search
CPC ..... A44C 5/14; A44C 5/147; A44C 5/2071; A44D 2203/00; G04B 37/1486
See application file for complete search history.

(56) References Cited

U.S. PATENT DOCUMENTS

| | | | | |
|---|---|---|---|---|
| 8,474,108 | B2 * | 7/2013 | Eisenberger | A44C 5/2071 63/3.1 |
| 10,132,340 | B2 * | 11/2018 | Russell-Clarke | A43B 1/0054 |
| 10,184,506 | B2 * | 1/2019 | Chen | G04B 37/1486 |
| 10,219,591 | B2 * | 3/2019 | Hatanaka | G04B 37/1486 |
| 10,226,104 | B2 * | 3/2019 | Aihara | A41F 1/002 |
| 10,244,830 | B2 * | 4/2019 | Schooley | G04B 37/1486 |
| 10,575,602 | B2 * | 3/2020 | Perkins | A44B 11/2596 |
| 10,609,990 | B2 * | 4/2020 | Rohrbach | A44C 5/14 |
| 11,528,970 | B2 * | 12/2022 | Xue | G04B 37/1486 |
| 11,553,766 | B2 * | 1/2023 | Moustafa | A44C 5/0007 |
| 11,744,333 | B2 * | 9/2023 | Webb | A44C 5/0007 224/267 |
| 2016/0215799 | A1 * | 7/2016 | Ely | H01F 7/0263 |
| 2019/0137948 | A1 | 5/2019 | Yaghmour | |
| 2019/0191828 | A1 * | 6/2019 | Wang | G04B 37/08 |
| 2020/0405017 | A1 | 12/2020 | Hu et al. | |
| 2023/0052443 | A1 | 2/2023 | Zhang | |

* cited by examiner

*Primary Examiner* — Jason W San
*Assistant Examiner* — Louis A Mercado
(74) *Attorney, Agent, or Firm* — Hemisphere Law, PLLC; Zhigang Ma

(57) ABSTRACT

A connector applied to a watchband is provided. The connector includes a main body, a first magnetic part, and a second magnetic part. The main body is configured for connecting a watchband body of the watchband, and provided with an installation groove and at least one opening communicating with the installation groove. The first magnetic part is movably installed in the installation groove and corresponds to one of the opening, and is able to extend out of or retract into the installation groove formed in the main body through the opening corresponding to the first magnetic part. The second magnetic part is installed in the installation groove. The second magnetic part is arranged in and limited in a moving direction of the first magnetic part. The first magnetic part and the second magnetic part have the same polarity on one end facing each other. The first magnetic part extends out of the installation groove formed in the main body under an action of the second magnetic part. A watchband and a watch including the connector is also provided.

7 Claims, 4 Drawing Sheets

CONNECTOR APPLIED TO WATCHBAND, WATCHBAND AND WATCH

TECHNICAL FIELD

The present disclosure relates to the technical field of watchbands, in particular to a connector applied to a watchband, a watchband and a watch.

BACKGROUND

The watchband is detachably connected with the watch body in general so that the watchband is convenient for a user to change. The applicant has applied for an invention patent with the application number of 2021218609467 (with the publication number of CN215532167U). In this scheme, two movable buckles are arranged. Elastic propping parts are installed between the movable buckles. The movable buckles are clamped into locating grooves of the watch body through the elastic propping parts. The applicant found that because the watchband is thin, it is difficult to install the long elastic propping parts into through holes, and the elastic propping part is of great elasticity, so great effort needs to be taken to press the movable buckles, and the watchband is inconvenient to install.

SUMMARY

In view of this, it is necessary to provide a connector applied to a watchband, a watchband and a watch, so that the convenience in installation is improved, and the installation of users is facilitated.

The present disclosure provides a connector applied to a watchband, including a main body, a first magnetic part and a second magnetic part. The main body is for connecting a watchband body of the watchband, and provided with an installation groove and at least one opening communicating with the installation groove. The first magnetic part is movably installed in the installation groove and corresponds to one of the opening, where the first magnetic part is able to extend out of or retract into the installation groove formed in the main body through the opening corresponding to the first magnetic part. The second magnetic part is installed in the installation groove. The second magnetic part is arranged in a moving direction of the first magnetic part. The first magnetic part and the second magnetic part have the same polarity on one end facing each other. The first magnetic part extends out of the installation groove formed in the main body under an action of the second magnetic part.

Further, the second magnetic part is movably installed in the installation groove formed in the main body. The second magnetic part is able to extend out of or retract into the installation groove formed in the main body, and the second magnetic part extends out of the installation groove under an action of the first magnetic part.

Further, the first magnetic part includes a first cap and a first magnetic body installed in the first cap, and the second magnetic part includes a second cap and a second magnetic body installed in the second cap. The first magnetic body and the second magnetic body have the same polarity on one end facing each other.

Further, two opposite sides of the first cap are each provided with a convex first flange, and two opposite sides of the second cap are each provided with a convex second flange. Two opposite side walls of the installation groove are each provided with a chute. The first flange and the second flange restrictively slide in the chute.

Further, the connector further includes balance blocks arranged on both sides of the first magnetic part and the second magnetic part on the main body.

Further, the main body is provided with a hinge structure for hinging with the watchband body of the watchband, or the main body is provided with an edge structure covered the watchband body of the watchband.

The present disclosure also provides a watchband, including a watchband body and the connector. The watchband body is connected with the main body of the connector.

The present disclosure also provides a watch, including a watch body and the watchband. The watch body is provided with a locating slot. The first magnetic part extends out of the installation groove formed in the main body under the action of the second magnetic part, and is clamped in the locating slot, to realize detachable connection between the watchband to the watch body.

Compared with the prior art, the present disclosure has the following beneficial effects. The first magnetic part and the second magnetic part are arranged oppositely, so that the first magnetic part and the second magnetic part repel each other in the same polarity. Under the action of the second magnetic part, the first magnetic part extends out of the main body, and then can be clamped into the locating groove of the watch body, so that a user can easily press the first magnetic part and overcome the repulsive force to retract first magnetic part into the main body, and the watchband is detached from the watch body.

DETAILED DESCRIPTION OF THE EMBODIMENTS

The following clearly and completely describes the technical scheme in the embodiments of the present disclosure with reference to the attached figures in the embodiments of the present disclosure. Apparently, the described embodiments are merely a part rather than all of the embodiments of the present disclosure. All other embodiments obtained by those skilled in the art based on the embodiments of the present disclosure without creative efforts shall fall within the protection scope of the present disclosure. It can be understood that the attached figures are for reference and illustration purposes only and are not intended to limit the present disclosure. The connection relationships shown in the attached figures are merely for ease of clear description and do not limit the manner of connection.

Figure 1:
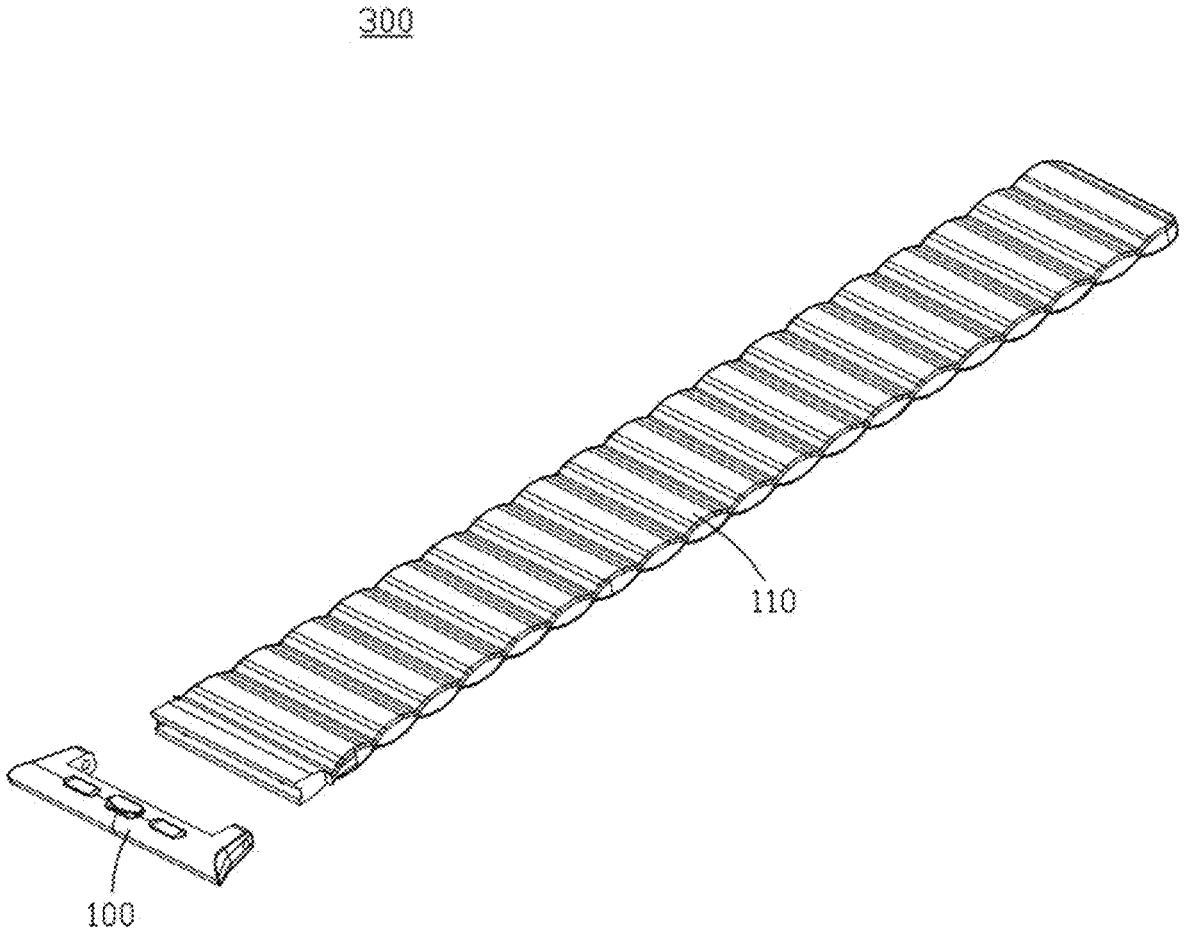
FIG. 1 is a structural schematic diagram of a watchband in a first embodiment of the present disclosure.

A first specific embodiment of the present disclosure provides a watchband 300, as shown in FIG. 1, including a watchband body 110 and a connector 100. The connector 100 is connected with the watchband body 110. The connector 100 can be transversely inserted into a slot defined on a watch body of a watch 1000, to connect the watchband body 110 to the watch body. A first magnetic part 20 and/or a second magnetic part 30 described later are/is matched with a locating slot formed in the watch body in a plugged manner, to realize detachable connection between the watchband 300 and the watch body.

Figure 2:
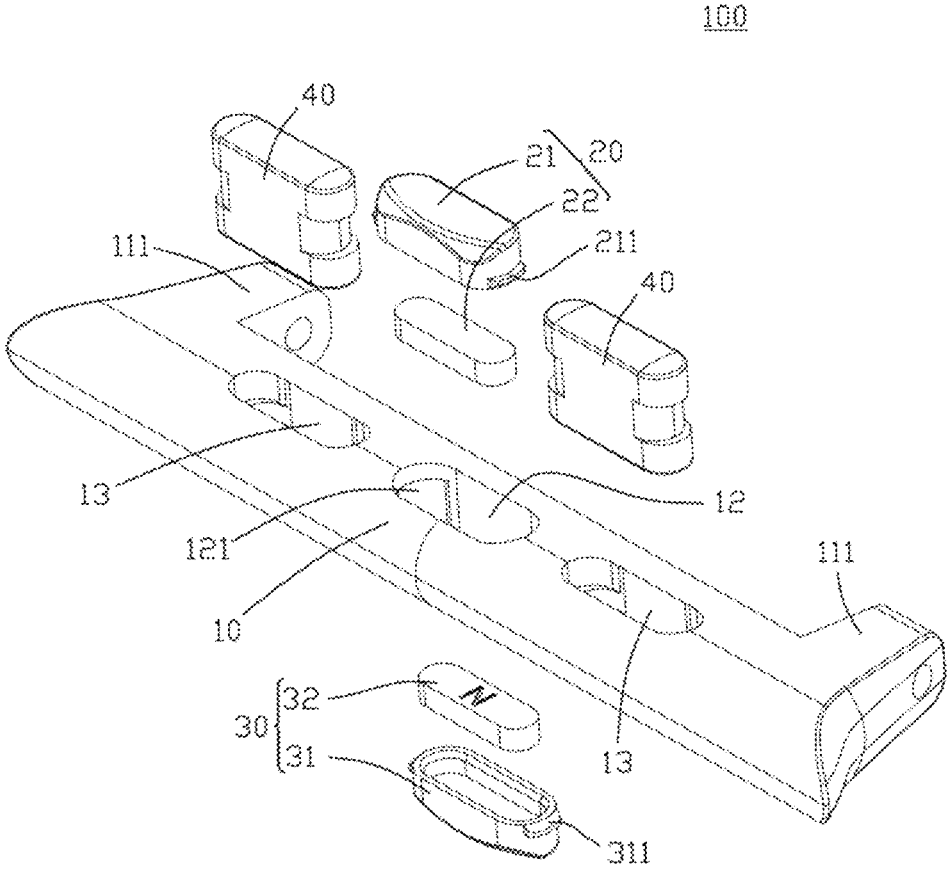
FIG. 2 is a structural schematic diagram of a connector in a first embodiment of the present disclosure.

In the first embodiment, as shown in FIG. 2, the connector 100 includes a main body 10 for connecting the watchband body 110, as well as a first magnetic part 20, a second magnetic part 30 and balance blocks 40 which are installed on the main body 10.

The main body 10 is provided with a hinge structure 111 for hinging with the watchband body 110, and the watchband body 110 is hinged with the hinge structure 111, so that the watchband body 110 can rotate relative to the connector 100.

The main body 10 is also provided with an installation groove 12. The first magnetic part 20 is movably installed in the installation groove 12, and can extend out of or retract into the installation groove 12 formed in the main body 10 when being moved in the installation groove 12.

In an embodiment, the installation groove 12 can penetrate through a front side and a back side of the main body 10 to form a through notch. The second magnetic part 30 can also be movably installed in the installation groove 12, and can extend out of or retract into the installation groove 12 formed in the main body 10 when being moved in the installation groove 12.

In this embodiment, the second magnetic part 30 is arranged in a moving direction of the first magnetic part 20. Similarly, the first magnetic part 20 is arranged in a moving direction of the second magnetic part 30.

Further, the first magnetic part 20 and the second magnetic part 30 have the same polarity on one end facing each other. That is, one end of the second magnetic part 30 facing the first magnetic part 20, and one end of the first magnetic part 20 facing the second magnetic part 30, are the same in polarity. For example, the ends of the first magnetic part 20 and the second magnetic part 30 that are facing each other are both S poles or N poles.

In a natural state, the first magnetic part 20 provides a repulsive force for the second magnetic part 30, and the second magnetic part 30 provides a repulsive force for the first magnetic part 20, so that under an action of the second magnetic part 30, the first magnetic part 20 naturally extends out of the main body 10 to form a convex buckle, and under an action of the first magnetic part 20, the second magnetic part 30 naturally extends out of the main body 10 to form another convex buckle. Therefore, the front side and the back side of the main body 10 of the connector 100 can both be inserted into the locating slot of the watch body to realize blind insertion.

When the connector 100 is inserted into the slot defined on the watch body, during the process of sliding along the slot, the first magnetic part 20 and the second magnetic part 30 will retract into the installation groove 12 formed in the main body 10. The first magnetic part 20 extends out of the main body 10 under the action of the second magnetic part 30, and is clamped in the locating slot, to realize detachable connection between the watchband 300 to the watch body. Similarly, the second magnetic part 30 extends out of the main body 10 under the action of the first magnetic part 20, and is clamped in the locating slot, to realize detachable connection between the watchband 300 to the watch body.

It can be understood that in other embodiments, the first magnetic part 20 is a movable part while the second magnetic part 30 is a fixed part.

In the first embodiment, the first magnetic part 20 includes a first cap 21 and a first magnetic body 22 installed in the first cap 21. The second magnetic part 30 includes a second cap 31 and a second magnetic body 32 installed in the second cap 31. The first magnetic part 20 and the second magnetic part 30 restrictively slide in the installation groove 12. The first magnetic body 22 and the second magnetic body 32 have the same polarity on one end facing each other. Specifically, two opposite sides of the first cap 21 are each provided with a convex first flange 211, and two opposite sides of the second cap 31 are each provided with a convex second flange 311. Two opposite side walls of the installation groove 12 are each provided with a chute 121. The first flange 211 and the second flange 311 restrictively slide in the chute 121 to prevent the first magnetic part 20 and the second magnetic part 30 from being separated from the installation groove 12.

The balance blocks 40 are arranged on the main body 10 and located on both sides of the first magnetic part 20 and the second magnetic part 30. Embedding grooves 13 are formed in the main body 10. The two embedding grooves 13 are formed in both sides of the first magnetic part 20 and the second magnetic part 30. The balance blocks 40 can avoid the problem of too tight or too loose assembly caused by mismatched gaps in the slot of the watch body.

Figure 3:
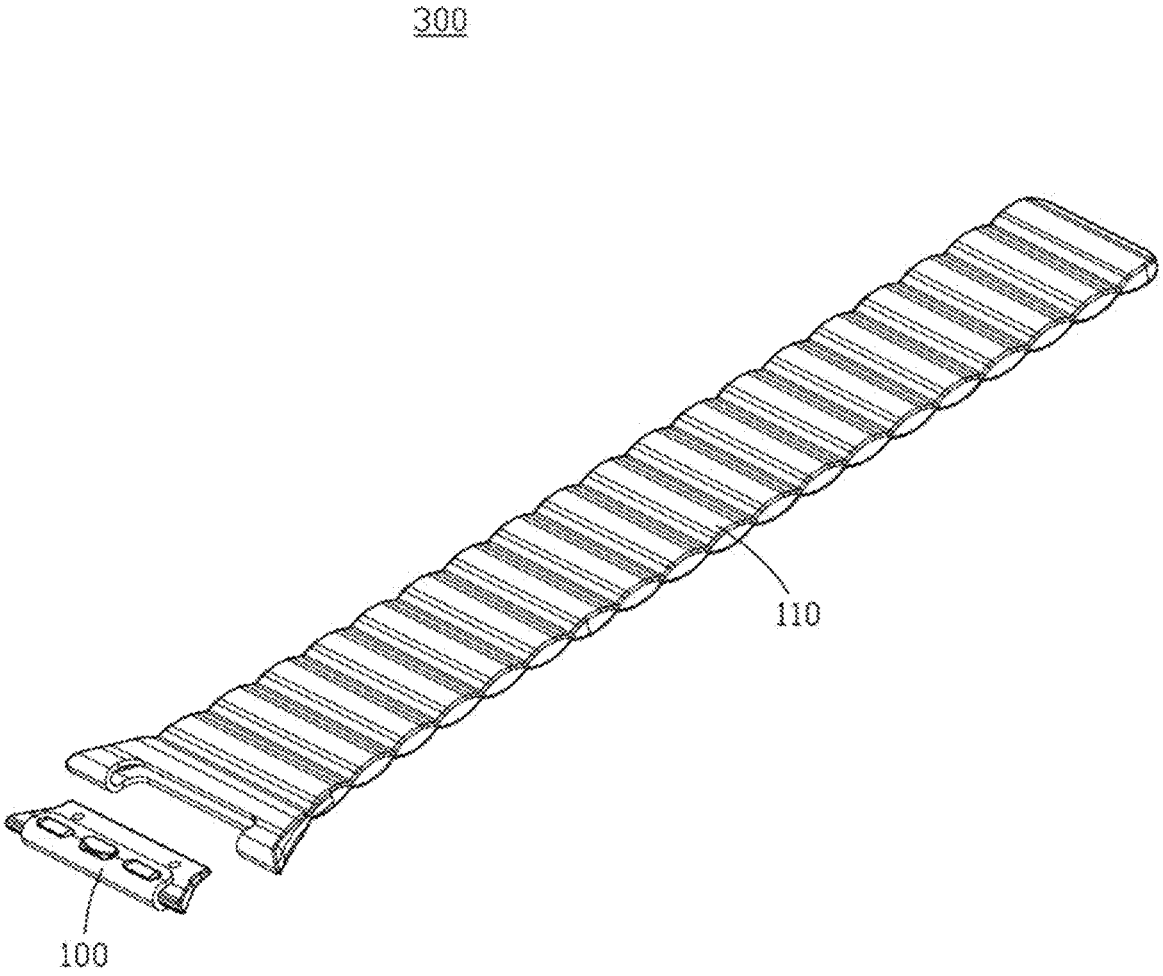
FIG. 3 is a structural schematic diagram of a watchband in a second embodiment of the present disclosure.
Figure 4:
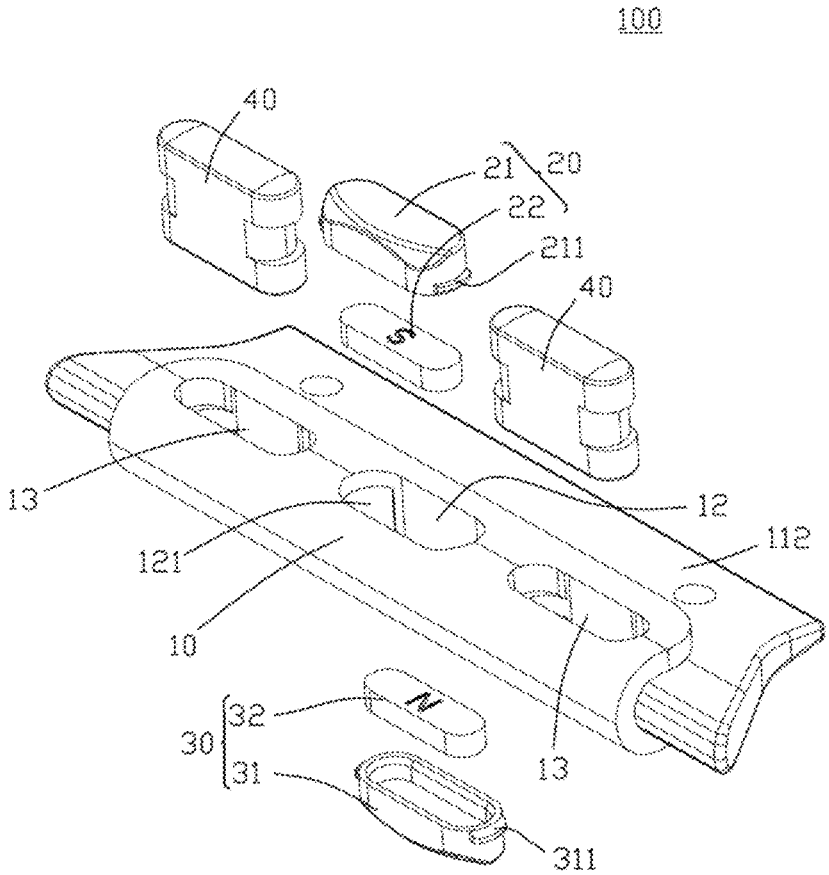
FIG. 4 is a structural schematic diagram of a connector in a second embodiment of the present disclosure.

A second specific embodiment of the present disclosure provides a watchband 300. Corresponding to the first embodiment, as shown in FIG. 3 and FIG. 4, the watchband 300 includes a watchband body 110 and a connector 100. The main body 10 of the connector 100 includes an edge structure 112 covered with the watchband body 110. Other structures of the connector 100 can refer to those in the first specific embodiment.

In various embodiments of the present disclosure, the first magnetic part 20 and the second magnetic part 30 are arranged oppositely, so that the first magnetic part 20 and the second magnetic part 30 repel each other in the same polarity. Under the action of the second magnetic part 30, the first magnetic part 20 extends out of the main body 10, and then can be clamped into the locating slot of the watch body, so that a user can easily press the first magnetic part 20 and overcome the repulsive force to retract first magnetic part 20 into the main body 10, and the watchband is detached from the watch body.

The foregoing descriptions are merely exemplary embodiments of the present disclosure, but are not intended to limit the present disclosure. Any modification, equivalent replacement, or improvement made within the spirit and principle of the present disclosure shall fall within the protection scope of the present disclosure.

What is claimed is:

1. A connector applied to a watchband, comprising:

a main body for connecting a watchband body of the watchband, wherein the main body is provided with an installation groove;

a first magnetic part movably installed in the installation groove, wherein the first magnetic part is able to extend out of or retract into the installation groove formed in the main body;

a second magnetic part installed in the installation groove, wherein the second magnetic part is arranged in a moving direction of the first magnetic part; wherein the first magnetic part and the second magnetic part have a same polarity on one end facing each other, and the first magnetic part extends out of the installation groove formed in the main body under an action of the second magnetic part;

wherein the second magnetic part is movably installed in the installation groove formed in the main body; the second magnetic part is able to extend out of or retract into the installation groove formed in the main body;

the second magnetic part extends out of the installation groove under an action of the first magnetic part; and wherein the first magnetic part comprises a first cap and a first magnetic body installed in the first cap, the second magnetic part comprises a second cap and a second magnetic body installed in the second cap; wherein the first magnetic body and the second magnetic body have the same polarity on one end facing each other.

2. The connector applied to the watchband according to claim 1, wherein two opposite sides of the first cap are each provided with a convex first flange, two opposite sides of the second cap are each provided with a convex second flange, two opposite side walls of the installation groove are each provided with a chute, and the first flange and the second flange restrictively slide in the chute.

3. The connector applied to the watchband according to claim 1, further comprising balance blocks arranged on both sides of the first magnetic part and the second magnetic part on the main body.

4. The connector applied to the watchband according to claim 1, wherein the main body is provided with a hinge structure for hinging with the watchband body of the watchband, or the main body is provided with an edge structure covered the watchband body of the watchband.

5. A watchband, comprising a watchband body and the connector according to claim 1, wherein the watchband body is connected with the main body of the connector.

6. The watchband according to claim 5, wherein the second magnetic part is movably installed in the installation groove formed in the main body; the second magnetic part is able to extend out of or retract into the installation groove formed in the main body; the second magnetic part extends out of the installation groove under an action of the first magnetic part.

7. The watchband according to claim 6, wherein two opposite sides of the first cap are each provided with a convex first flange, two opposite sides of the second cap are each provided with a convex second flange, two opposite side walls of the installation groove are each provided with a chute, and the first flange and the second flange restrictively slide in the chute.

* * * * *